US006131406A

United States Patent [19]

Barowsky et al.

[11] Patent Number: 6,131,406

[45] Date of Patent: Oct. 17, 2000

[54] REFRIGERANT COMPRESSOR

[75] Inventors: Helmut Barowsky, Bergfelde; Volker Pollrich, Schkeuditz, both of Germany

[73] Assignee: Bitzer Kuehlmaschinenbau GmbH, Sindelfingen, Germany

[21] Appl. No.: 09/261,457

[22] Filed: Feb. 19, 1999

Related U.S. Application Data

[63] Continuation of application No. PCT/EP98/03745, Jun. 19, 1998.

[30] Foreign Application Priority Data

Jun. 25, 1997 [DE] Germany ..... 197 26 943

[51] Int. Cl.[7] ..... F25B 31/00

[52] U.S. Cl. ..... 62/505

[58] Field of Search ..... 62/505

[56] References Cited

U.S. PATENT DOCUMENTS

| | | | |
|---|---|---|---|
| 3,236,062 | 2/1966 | Roach | 62/505 |
| 3,931,718 | 1/1976 | Haselden | 62/505 |
| 4,743,176 | 5/1988 | Fry . | |
| 4,995,791 | 2/1991 | Loprete . | |
| 5,007,809 | 4/1991 | Kimura et al. . | |
| 5,148,684 | 9/1992 | Leimbach et al. | 62/197 |
| 5,224,840 | 7/1993 | Dreiman et al. . | |
| 5,366,352 | 11/1994 | Deblois et al. . | |
| 5,540,061 | 7/1996 | Gommori et al. | 62/277 |
| 5,653,119 | 8/1997 | Kimura et al. | 62/228.5 |

FOREIGN PATENT DOCUMENTS

| | | |
|---|---|---|
| 34 17 847 | 11/1984 | Germany . |
| 238 645 | 8/1986 | Germany . |
| 44 29 098 | 2/1996 | Germany . |

*Primary Examiner*—Henry Bennett
*Assistant Examiner*—Mark Shulman
*Attorney, Agent, or Firm*—Barry R. Lipsitz

[57] ABSTRACT

In order to improve a refrigerant compressor comprising a motor unit which has a motor and a cooling duct for the motor originating from an outer cooling duct connection as well as a compressor unit which has a compressor stage with a compressor stage inlet and a compressor stage outlet and a suction duct originating from an outer suction connection, this duct, like the cooling duct, being guided to the compressor stage inlet, such that the cooling can be realized variably with as few constructional alterations as possible it is suggested that an outer connection unit be provided, on which the cooling duct connection and the suction connection are arranged, that the connection unit have a receiving means and an adjustment part which can be inserted into the receiving means in at least two different positions and that as a result of the various positions of the adjustment part the amounts supplied to the cooling duct connection and the suction connection of the total quantity of the suction gas supplied via an outer gas supply connection be variably adjustable.

16 Claims, 3 Drawing Sheets

REFRIGERANT COMPRESSOR

This appln is a cont of PCT/EP98/03745 filed Jun. 19, 1998.

The invention relates to a refrigerant compressor, comprising a motor unit which has a motor and a cooling duct for the motor originating from an outer cooling duct connection as well as a compressor unit which has a compressor stage with a compressor stage inlet and a compressor stage outlet and a suction duct originating from an outer suction connection, this suction duct like the cooling duct being guided to the compressor stage inlet.

Refrigerant compressor s of this type are known from the state of the art. In this case, the piping system for the suction gas is guided either to the cooling duct connection or to the suction connection, depending on what type of cooling is intended to be realized in the case of the motor unit.

The object underlying the invention is therefore to improve a refrigerant compressor of the generic type such that the cooling can be realized variably with as few constructional alterations as possible.

This object is accomplished in accordance with the invention, in a refrigerant compressor of the generic type, in that an outer connection unit is provided, on which the cooling duct connection and the suction connection are arranged, that the connection unit has a receiving means and an adjustment part which can be inserted into the receiving means in at least two different positions and that as a result of the various positions of the adjustment part the amounts supplied to the cooling duct connection and the suction connection of the total quantity of the suction gas supplied via an outer suction gas connection (i.e., gas supply connection) can be variably adjusted.

The advantage of the inventive solution is thus to be seen in the fact that in the case of the refrigerant compressor only one gas supply connection is provided, to which the piping for the suction gas is to be guided, and that, depending on the field of use, a different type of cooling, namely a variable suction gas cooling of the motor unit as far as the exclusive air cooling of the motor unit, can take place in a simple manner merely by way of an altered installation of the adjustment part. This means that by varying the amount of suction gas which flows into the cooling duct connection and the amount of suction gas which flows into the suction connection the cooling of the motor unit by the suction gas can be adjusted in adaptation to the respective use.

As a result, installation of the refrigerant compressor can be prepared in a standardized manner irrespective of the type of cooling of the motor unit which is intended to be realized.

A particularly favorable solution provides for a connection to be provided with the adjustment part between an outer gas supply connection and the cooling duct connection in one of the positions and a connection to be provided with the adjustment part between the gas supply connection and the suction connection in another one of the positions.

It is thus possible to set an essentially exclusive suction gas cooling and an essentially exclusive air cooling of the motor unit.

The type of positions, in which the adjustment part is intended to be insertable into the receiving means, is not specified in greater detail in conjunction with the inventive solution described thus far. It is, for example, conceivable to install the adjustment part in two positions differing from one another as a result of a translational movement. This does, however, have the disadvantage that the two positions of the gas supply connection likewise differ due to their spatial arrangement.

For this reason, a particularly advantageous solution provides for the adjustment part to be insertable into the receiving means in positions turned about an axis of symmetry of the gas supply connection. This solution has the advantage that as a result of the turning about an axis of symmetry of the gas supply connection the axis of symmetry of the gas supply connection itself remains locally unchanged and thus the pipes leading to the gas supply connection are likewise to be guided to the same location independently of the type of cooling of the motor unit.

This solution is particularly favorable when the gas supply connection is designed to be rotationally symmetric so that it is possible to realize the two positions of the adjustment part by way of two positions which are, in principle, turned optionally in relation to one another.

With respect to the type of installation of the adjustment part, no further details have likewise been given thus far. It would, for example, be conceivable to design the connection unit such that the adjustment part can be mounted in the corresponding position after opening of the compressor housing. In order, however, to avoid this complicated opening of the compressor housing, it is preferably provided for the adjustment part to be insertable into the receiving means via an outer opening of the connection unit.

This means that, on the one hand, the adjustment part is easy to exchange and, on the other hand, can be brought into the two positions in a simple manner without manipulations of the refrigerant compressor itself being necessary.

It has not so far been specified in detail how the connection unit itself is intended to be designed. It would, for example, be conceivable to design the connection unit such that the adjustment part provides the connection between the gas supply connection and the suction connection or the cooling duct connection with an element located outside the receiving means. A particularly favorable solution provides for the receiving means to have an interior space, in which the cooling duct connection and the suction connection open, and that in each of the positions of the adjustment part either the cooling duct connection or the suction connection can be covered. This solution thus has the advantage that it is of a very compact construction since the closure of the cooling duct connection or the suction connection is brought about by an area of the adjustment part engaging in the interior space.

A particularly favorable solution provides for the interior space of the receiving means to have an approximately cylindrical shape since, in this case, the adjustment part corresponding hereto is simple to produce.

A particularly advantageous solution provides, in this respect, for the interior space of the receiving means to extend as a recess into a partition wall which separates the cooling duct and the suction duct from one another since, in this case, the cooling duct connection and the suction connection may be arranged particularly favorably such that they open into the interior space.

A solution which is particularly expedient with regard to the compact mode of construction provides for the adjustment part to be insertable into the interior space and thus be integrated into the inventive refrigerant compressor in a space-saving manner.

In order, in addition, to bring about a filtering of the suction gas at the same time, it is preferably provided for the adjustment part to accommodate a suction gas filter.

The adjustment part may be realized in an optionally simple manner when this has a cover member, with which either the cooling duct connection or the suction connection can be closed so that the suction gas supplied via the gas supply connection enters the respective connection which is not closed.

The cover member could be designed in an optionally complex manner. A particularly advantageous solution provides for the cover member to have an approximately semicylindrical shape so that the cooling duct connection or the suction connection may be covered with it in a simple manner when these open into a cylindrical wall of the interior space.

In order to be able to fix the adjustment part in the respective position on the connection unit, it is preferably provided for a flange plate to be arranged on the adjustment part, this flange plate being placeable on a connection flange of the connection unit so that, on the one hand, the adjustment part is fixed in position with this plate and, on the other hand, the elements required for the supply of the suction gas could be connected to the flange plate itself.

In this case, it is particularly advantageous when the suction gas shutoff valve can be mounted on the flange plate of the adjustment part.

In order to be able, at the same time, to recognize by means of the flange plate the position, in which the adjustment part is located, it is preferably provided for the flange plate to have on one side of the adjustment part a different shape to the opposite side. This means that the position of the flange plate and thus the position of the adjustment part can already be recognized in a simple manner by the differing shape of the respective sides located opposite one another.

A solution, in which the flange plate and the adjustment part securely arranged on this can be mounted on the receiving means in two positions turned through 180° in relation to one another, is particularly favorable. With this solution, the two positions of the adjustment part may be realized in a simple manner with standard flange attachments which have a two-fold symmetry without additional, special attachment measures being necessary.

Additional features of the invention are the subject matter of the following description as well as the drawings illustrating one embodiment.

Figure 1:
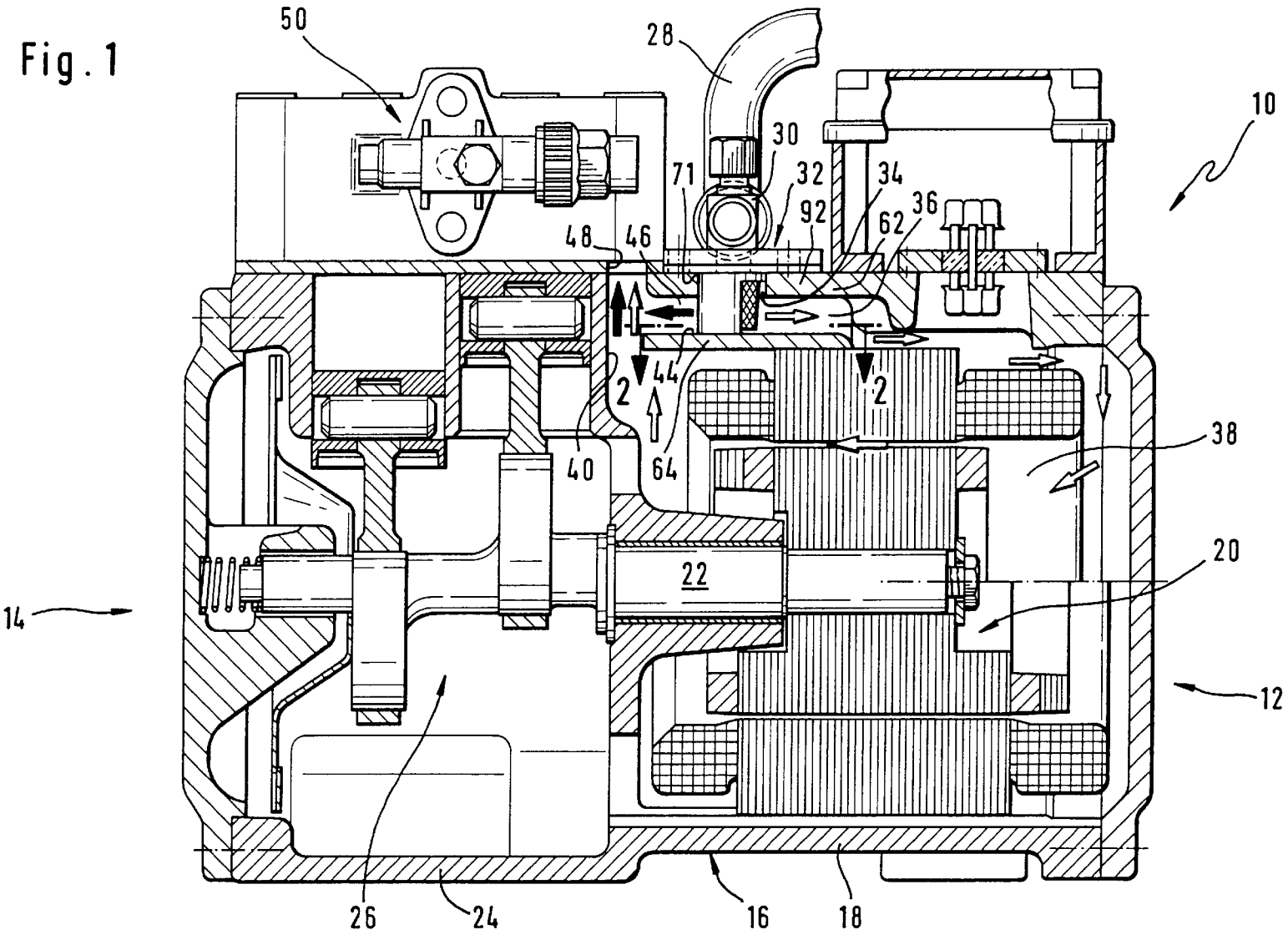
FIG. 1 shows a longitudinal section through an inventive refrigerant compressor.

One embodiment of an inventive refrigerant compressor 10 comprises a motor unit designated as a whole as 12 and a compressor unit designated as a whole as 14 which are both arranged in a common compressor housing 16. One section 18 of the compressor housing 16 surrounds the motor, preferably an electromotor, which is designated as a whole as 20 and, for its part, drives via a shaft 22 a reciprocating compressor 26 arranged in a section 24 of the compressor housing 16 and forming a compressor stage.

The supply of refrigerant takes place via a suction gas pipe 28 which is guided to a suction gas shutoff valve 30. The suction gas shutoff valve 30 is mounted on a connection unit which is designated as a whole as 32 and communicates via a cooling duct connection 34 with a cooling duct 36 which is provided in the section 18 of the compressor housing 16 and serves to convey drawn-in refrigerant through a motor chamber 38 accommodating the motor 20 and thus also through the motor 20, wherein the cooling duct 36 conveys the drawn-in refrigerant to a cooling duct outlet 40 after it has flowed through the motor 20.

Furthermore, refrigerant can be supplied from the connection unit 32 via a suction connection 44 to a suction duct 46 which is guided to a compressor stage inlet 48. Moreover, the cooling duct outlet 40 also preferably opens into the suction duct 46 and so refrigerant flowing through the cooling duct 36 can also be supplied via the cooling duct outlet to the suction duct 46 and via this to the compressor stage inlet 48.

In the compressor stage 26, a compression of the refrigerant takes place which can then be discharged via a compressor stage outlet 50.

Figure 2:
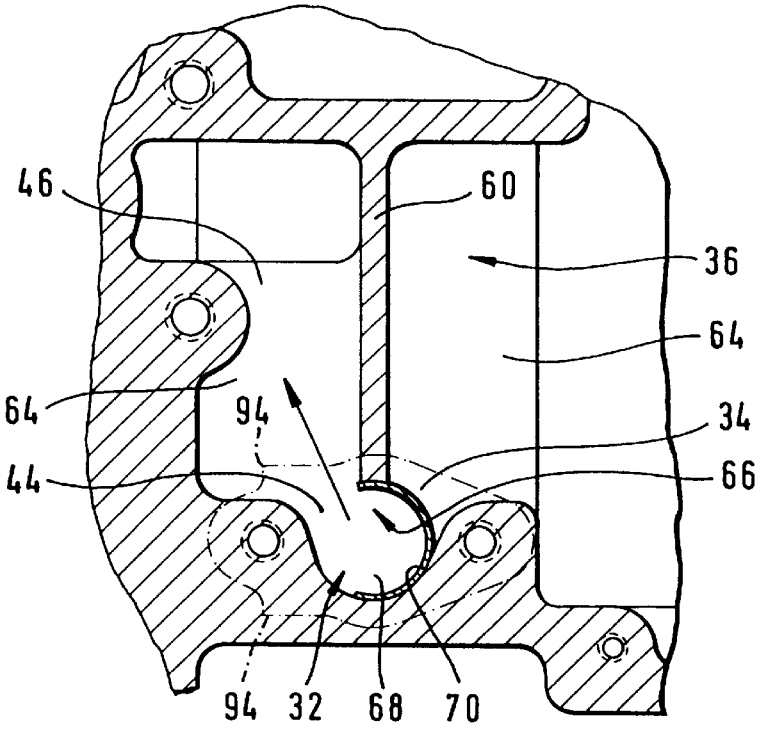
FIG. 2 shows a section along line 2—2 in FIG. 1 with a closed cooling duct connection.
Figure 3:
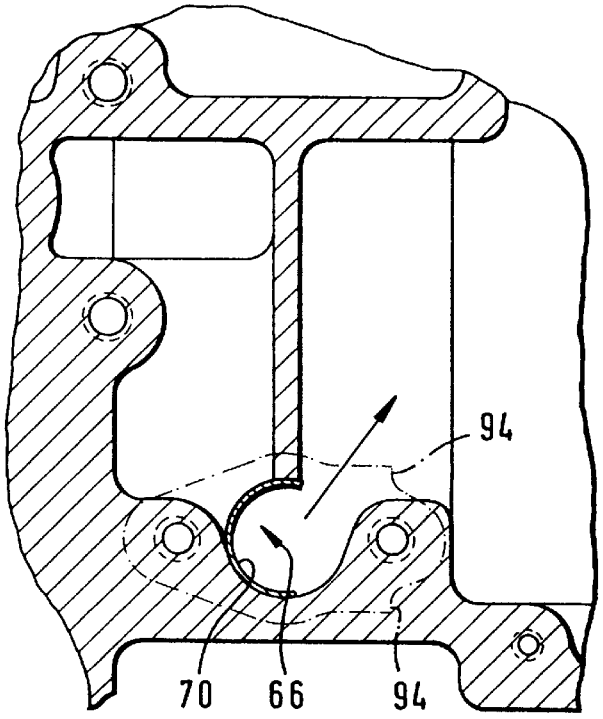
FIG. 3 shows a section along line 2—2 in FIG. 1 with a closed suction connection.

As illustrated in FIGS. 2 and 3 on a larger scale, the cooling duct 36 and the suction duct 46 are separated by a wall 60 provided in the compressor housing 16 and following the wall 60 limited by an outer housing wall 62 and an inner housing wall 64 extending at a distance from this. The wall 60 extends as far as the connection unit 32 and is provided with a recess for forming a receiving means 66 so that the receiving means 66 can form an interior space 68 which extends between the outer housing wall 62 and the inner housing wall 64 and into which the cooling duct connection 34 and the suction connection 44 open.

Figure 4:
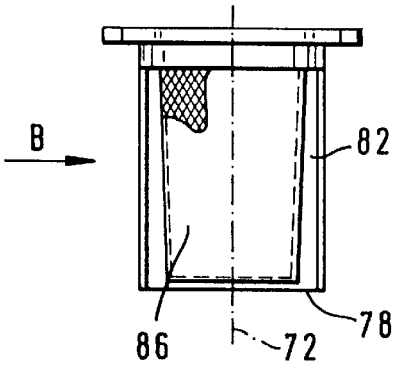
FIG. 4 shows a plan view of an inventive adjustment part in the direction of arrow A in FIG. 5.
Figure 5:
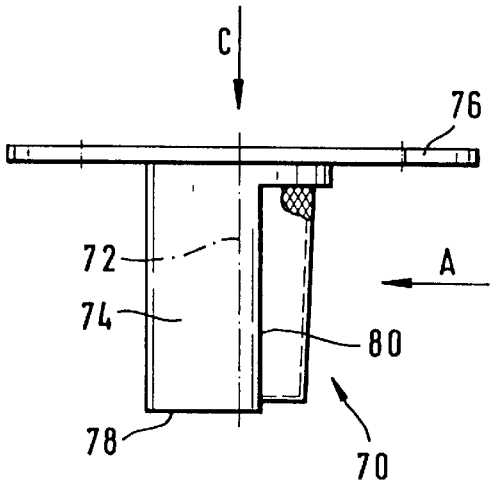
FIG. 5 shows a plan view of the inventive adjustment part in the direction of arrow B in FIG. 4
Figure 6:
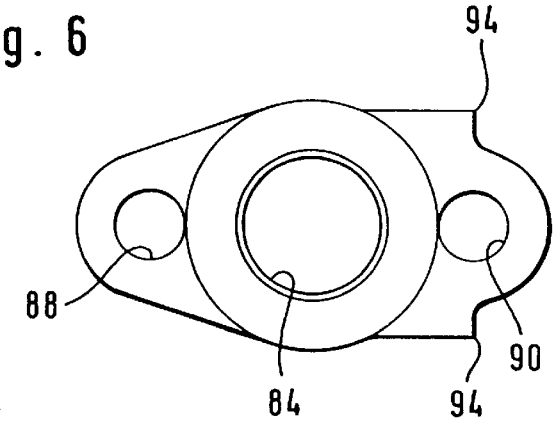
FIG. 6 shows a plan view of the inventive adjustment part in the direction of arrow C in FIG. 5.

An adjustment part designated as a whole as 70 can be inserted into the interior space 68 of the receiving means 66 via an outer opening 71 and, as illustrated in FIGS. 4 and 5, has a cover member 74 which is designed to be approximately semicylindrical with its outer casing surface in relation to a cylinder axis 72 and, for its part, is securely connected to a flange plate 76.

The cover member 74 designed to be approximately semi-cylindrical in relation to the axis 72 can be inserted into the receiving means 66 such that the cylinder axis 72 extends transversely, preferably at right angles to the outer housing wall 62 and inner housing wall 64, wherein the cover member 74 is of such a length in the direction of the cylinder axis 72 that it reaches with its underside 78 facing away from the flange plate 76 as far as the inner housing wall 64 in the state inserted into the receiving means 66, and preferably terminates with it.

The cover member 74 surrounds an inflow chamber 82 in the form of a cylinder casing and, in addition, has on account of its only approximately semicylindrical shape an opening 80, via which suction gas can exit from the inflow chamber 82 surrounded by the cover member 74.

The flange plate 76 has, in addition, an inflow opening 84 which represents a gas supply connection, via which suction gas can flow into the inflow chamber 82 in the direction of the cylinder axis 72 from the suction gas shutoff valve 30.

A suction gas filter 86 can preferably be inserted into the inflow chamber 82 surrounded by the cover member 74, namely such that the suction gas flowing in from the suction gas shutoff valve 30 via the inflow opening 84 first passes through the suction gas filter 86 and then enters the inflow chamber 82.

The cover member 74 with the flange plate 76 is, as illustrated in FIGS. 2 and 3, either insertable into the receiving means such that the cover member 74 essentially covers the cooling duct connection 34 and thus prevents the suction gas from entering the cooling duct 36 from the inflow chamber 82 but the opening 80 faces the suction connection 44 so that the suction gas can enter the suction duct 46 from the inflow chamber 82 via the suction connection 44, as illustrated in FIG. 2.

It is, however, also possible to insert the cover member 74 into the receiving means 66 with the flange plate 76 turned through 180° around the cylinder axis 72 of the cover member so that the cover member 74 covers the suction connection 44 and prevents the suction gas from being able to enter the suction duct 46 from the inflow chamber 82. The suction gas then flows via the opening 80 facing the cooling duct connection 34 into the cooling duct 36 via the cooling duct connection 34, flows, as illustrated in FIG. 1, through the motor chamber 38 and enters the suction duct 46 via the cooling duct outlet 40.

It is, however, also possible to design the cover member 74 such that this covers the cooling duct connection 34 or the suction connection 44 only partially so that a certain amount of the suction gas always enters this but the greater amount of suction gas enters the suction connection 44 or the cooling duct connection 34, respectively. Furthermore, it is also possible to provide intermediate positions of the cover member 74, in which this partially covers the suction connection 44 and the cooling duct connection 34 so that the amounts of suction gas entering the suction connection 44 and the cooling duct connection 34 can be adjusted in intermediate steps.

To fix the cover member 74 in position with the flange plate 76, the flange plate 76 is provided with two screw holes 88, 90 which are arranged in relation to the cylinder axis 72 so as to be located opposite one another and so the flange plate 76 can be connected to the outer housing wall 62 in two positions turned through 180° around the cylinder axis 72.

The flange plate 76 represents at the same time a connection flange for the suction gas shutoff valve 30 which can be placed with its connection flange on the flange plate 76 and can be connected to this by means of screws together with a connection flange 92 of the connection unit 52.

The flange plate 76 is designed to be asymmetrical with respect to the cylinder axis 72 and has, for example, on the side of the opening 80 additional projections 94 which are not present on the opposite side, i.e. on the closed side of the cover member 74 so that it is apparent from these projections 94, in which of the two positions turned through 180° in relation to one another around the cylinder axis 72 the cover member 74 is inserted with the flange plate 76.

What is claimed is:

1. A refrigerant compressor comprising:

a motor unit having a motor;

a cooling duct for said motor, said cooling duct originating from a cooling duct connection, a compressor unit having a compressor stage with a compressor stage inlet and a compressor stage outlet, and a suction duct originating from a suction connection, said suction and cooling ducts being guided to the compressor stage inlet, an outer connection unit having an outer gas supply connection, the cooling duct connection and suction connection being arranged on said outer connection unit, the connection unit having a receiving means and an adjustment part insertable into the receiving means in at least two different positions, and as a result of the various positions of the adjustment part, the amounts of the total quantity of suction gas supplied to the cooling duct connection and the suction connection via said outer gas supply connection being variably adjustable.

2. A refrigerant compressor as defined in claim 1, wherein:

in one of the positions of the adjustment part, a connection is provided with the adjustment part between said outer gas supply connection and the cooling duct connection, and in another one of the positions of the adjustment part, a connection is provided with the adjustment part between said outer gas supply connection and the suction connection.

3. A refrigerant compressor as defined in claim 1, wherein the adjustment part is insertable into the receiving means in positions turned about an axis of symmetry of the outer gas supply connection.

4. A refrigerant compressor as defined in claim 1, wherein the adjustment part is insertable into the receiving means via an outer opening of the connection unit.

5. A refrigerant compressor as defined in claim 1, wherein:

the receiving means has an interior space, and the cooling duct connection and the suction connection open into said interior space.

6. A refrigerant compressor as defined in claim 5, wherein in each of the positions of the adjustment part, either the cooling duct connection or the suction connection is covered.

7. A refrigerant compressor as defined in claim 5, wherein the interior space of the receiving means has an approximately cylindrical shape.

8. A refrigerant compressor as defined in claim 5, wherein the interior space of the receiving means extends as a recess into a wall separating the cooling duct and the suction duct from one another.

9. A refrigerant compressor as defined in claim 5, wherein the adjustment part is insertable into the interior space.

10. A refrigerant compressor as defined in claim 1, wherein the adjustment part accommodates a suction gas filter.

11. A refrigerant compressor as defined in claim 1, wherein the adjustment part has a cover member for closing either the cooling duct connection or the suction connection.

12. A refrigerant compressor as defined in claim 11, wherein the cover member has an approximately semi-cylindrical outer shape.

13. A refrigerant compressor as defined in claim 1, wherein a flange plate is arranged on the adjustment part for placement on a connection flange of the connection unit.

14. A refrigerant compressor as defined in claim 13, wherein the suction gas shutoff valve is mountable on the flange plate.

15. A refrigerant compressor as defined in claim 13, wherein the flange plate has a different shape on one side of the adjustment part than on the opposite side of the adjustment part.

16. A refrigerant compressor as defined in claim 13, wherein the adjustment part with the flange plate securely arranged thereon is mountable on the receiving means in two positions turned through 180° in relation to one another.

* * * * *